US005280278A

United States Patent [19]

Vick

[11] Patent Number: 5,280,278

[45] Date of Patent: Jan. 18, 1994

[54] TFEL MATRIX PANEL DRIVE TECHNIQUE WITH IMPROVED BRIGHTNESS

[75] Inventor: Gerald L. Vick, Mt. Vernon, Iowa

[73] Assignee: Rockwell International Corporation, Seal Beach, Calif.

[21] Appl. No.: 287,750

[22] Filed: Dec. 19, 1988

[51] Int. Cl.[5] ..... G09G 3/30

[52] U.S. Cl. ..... 345/76; 345/208

[58] Field of Search ..... 340/781, 805, 825.81; 315/169.3

[56] References Cited

U.S. PATENT DOCUMENTS

| | | | |
|---|---|---|---|
| 3,573,788 | 4/1971 | Molmar . | |
| 4,070,663 | 1/1978 | Kanatani et al. | 340/811 |
| 4,152,626 | 5/1979 | Hatta et al. | 340/781 |
| 4,275,336 | 6/1981 | Marrello et al. | 315/169.3 |
| 4,554,539 | 11/1985 | Graves | 340/805 |
| 4,594,589 | 6/1986 | Ohba et al. | 340/805 |
| 4,636,789 | 1/1987 | Yamaguchi et al. | 340/805 |
| 4,730,140 | 3/1988 | Masubuchi | 315/169.3 |

*Primary Examiner*—Jeffery A. Brier

*Attorney, Agent, or Firm*—Gregory G. Williams; M. Lee Murrah; H. Fredrick Hamann

[57] ABSTRACT

An improved TFEL matrix panel drive technique, for improving the brightness output, which utilizes a voltage wave form applied to the row which possesses a first initial peak voltage region, which when combined with a column voltage, exceeds a predetermined threshold voltage for the emission of luminescence, the first initial peak voltage region being relatively short in duration and higher in voltage, with respect to a secondary extended plateau region which when taken in combination with any column voltage is below the predetermined threshold for emission of luminescence. The technique accomplishes its result by allowing for the application of voltage signals to more than one row at a time however only one row is permitted to possess a first initial peak voltage region at any one given time.

12 Claims, 3 Drawing Sheets

FIG 1
PRIOR ART
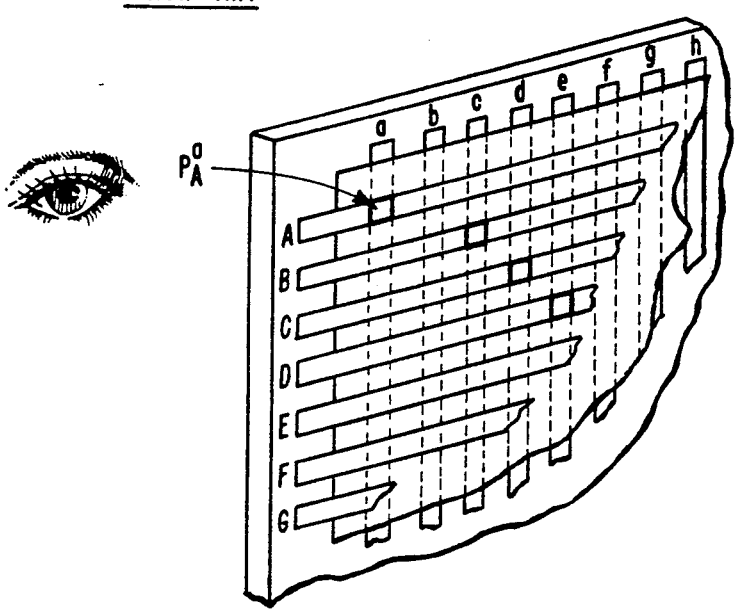
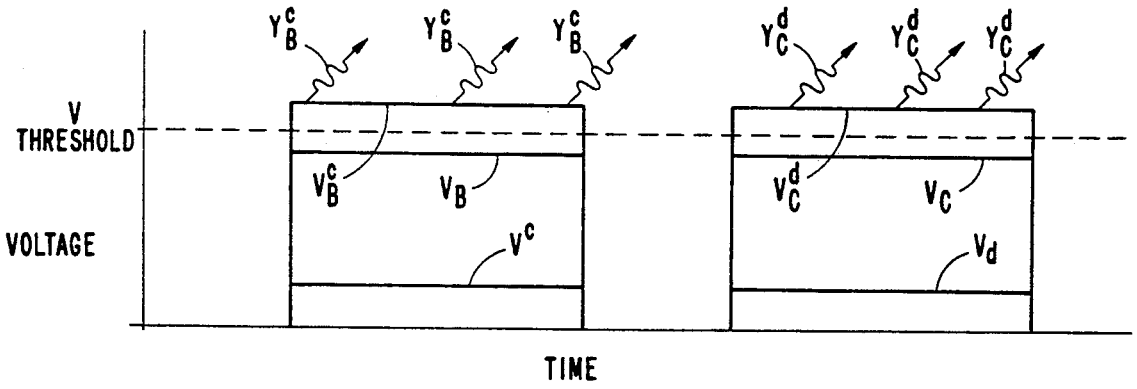
PRIOR ART
FIG 2

TFEL MATRIX PANEL DRIVE TECHNIQUE WITH IMPROVED BRIGHTNESS

FIELD OF THE INVENTION

This invention relates to the field of electronics and more particularly to the field of driver electronics for thin film electroluminescent display devices.

BACKGROUND OF THE INVENTION

With the ever expanding frontiers of space and aviation, and with modern aircraft now operating at altitudes which only a few decades ago were thought to be impossible, it is becoming increasingly important to overcome some problems introduced by high altitude flight. At high altitudes, the ambient light often is quite bright and may adversely affect the operation of optical avionics equipment.

One particular type of avionics equipment where the high ambient light is posing vexing problems, is in the use of thin film electroluminescent (TFEL) matrix display panels.

Electroluminescence is the emission of light from a luminescent material when an electric field of sufficient amplitude is applied to the material. This phenomenon has been used to construct display panels by using the luminescent material as the dielectric in a parallel plate capacitor in which one of the conducting plates is transparent. When alternating voltages or pulses are applied to the plates, the luminescent material emits light.

Electroluminescent video display panels have been constructed by depositing conductive rows and columns on opposite, non-conductive plates of a capacitor to form an x-y matrix. A typical TFEL matrix display panel of the prior art is shown in FIG. 1. The coordinates of the matrix are the pixels of the display. When a voltage differential is created between a row and a column, the luminescent material between the crossing electrodes emits light at that pixel.

Electroluminescent technology offers the potential of providing compact, flat panel displays rather than the bulky cathode ray tube now in wide use. Small electroluminescent display panels can be driven by integrated solid state circuits to provide miniature video systems that are not practical using cathode ray tube displays.

To realize the potential of electroluminescent displays, drive circuits are required which are inexpensive, reliable, require low power, and fully utilize the electroluminescent capacity of the display, including the output of a sufficiently bright display.

In the past, numerous techniques and drive circuits have been used to operate TFEL displays. One particular prior art technique is shown in FIG. 2, which consists of a voltage versus time plot of the voltages applied to the rows and columns of the panel. A threshold voltage, which varies depending on the phosphor used, is shown, and this threshold voltage is the voltage below which no new luminescence is initiated. In this technique, a voltage $V_B$ is applied to the row electrode B, and a voltage $V^c$ is applied to column electrode c individually, both of these voltages are less than the threshold voltage, but at the pixel $P^c{}_B$ the combined voltages exceed the threshold and luminescence is thereby initiated at that point. Both $V_B$ and $V^c$ continue for a predetermined time period then they both are eliminated. Next a voltage $V_C$ is applied to row C and a voltage $V^d$ is applied to column d. This results in luminescence from pixel $P^d{}_C$.

With this technique only one row is addressed at any one time. The overall brightness of the display is limited by the refresh frequency which is in turn limited by the pulse width.

Consequently, there exists a need for improvement in TFEL drive circuits and techniques which provide for increased brightness and increased refresh frequency without altering the effective pulse width so much as to lose the benefit of the increased refresh frequency. cl

OBJECTS OF THE INVENTION

It is an object of the present invention to provide a TFEL matrix display panel drive technique which allows for increasing the brightness of TFEL displays.

It is a feature of the present invention to include row or column voltage wave forms which exhibits a relatively short initial peak followed by a relatively long plateau region.

It is an advantage of the present invention to provide a sustaining voltage by the plateau region of the row or column voltage wave form, which allows for continued luminescence.

It is another object of the present invention to provide a technique which allows for the capability of addressing multiple rows at any one given time.

It is another feature of the present invention to have a relatively extended plateau region of the row or column voltage wave form, at a voltage level sufficiently below the threshold voltage level, so that, any row or column voltages which might be applied at the same time to any one given pixel does not, in combination, exceed the threshold voltage for the predetermined phosphor.

It is another advantage of the present invention to provide for the ability to address multiple rows at the same time, so long as only one row or column voltage has its wave form in the initial peak region.

It is yet another object of the present invention to provide for an increased refresh frequency rate.

It is another feature of the present invention to provide a voltage wave form applied to the row or columns so that the initial peak portion of the voltage wave form is relatively short in duration to the extended plateau region of the wave form.

It is yet another advantage of the present invention to allow for increased refresh frequency rate by addressing multiple rows at any one given time so long as the initial peak portion of the wave form of any one given row is the only initial peak wave form region of any voltage wave form on any row.

SUMMARY OF THE INVENTION

The present invention provides a TFEL matrix panel drive technique with improved brightness capabilities which is designed to satisfy the aforementioned needs, fulfill the earlier propounded objects, contain the above described features, and produce the previously stated advantages.

The invention is carried out in a "multi-row address system", in the sense that, more than one row can be addressed at any one given time.

Accordingly, the present invention relates to an improved TFEL matrix panel drive technique which utilizes a voltage wave form applied to the rows or columns which possesses a first initial peak voltage region, which is relatively short in duration, and a secondary extended plateau region which is relatively lower in voltage and longer in duration as compared to the peak region.

BRIEF DESCRIPTION OF THE DRAWINGS

The invention may be more fully understood by reading the following description of the preferred embodiments of the invention in conjunction with the appended drawings wherein:

FIG. 1 is a schematic representation of a typical TFEL matrix display panel of the prior art, which shows the columns labeled with lower case letters and the rows labeled with upper case letters. A particular picture element, or pixel is depicted by an upper case P, which relates to pixel and a subscript in upper case letters which relates to the row and a superscript in lower case letters which relates to the particular column.

FIG. 2 is a voltage time plot of a typical prior art TFEL matrix drive panel technique, which shows how the voltages applied to a given row and a given column are combined to exceed the threshold voltage for the particular chosen phosphor.

DETAILED DESCRIPTION

Figure 3A:
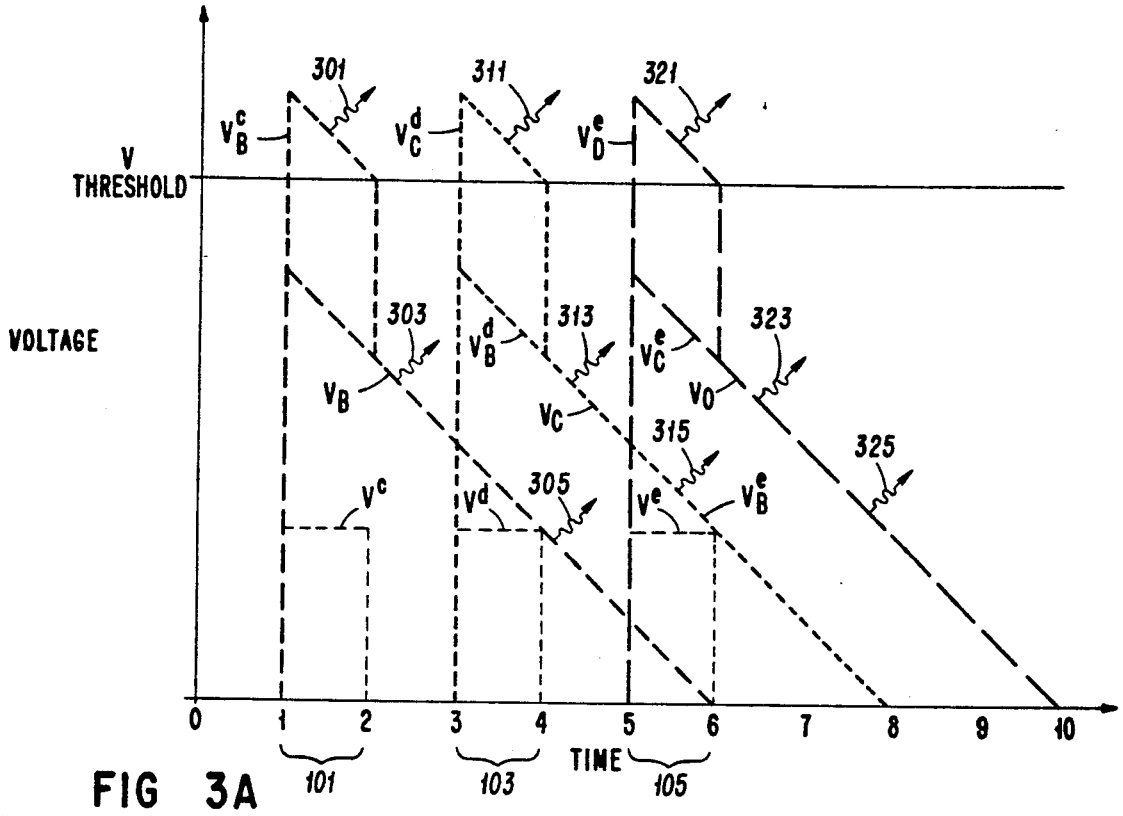
FIG. 3A is a representation of a voltage time plot of the present invention which displays a saw tooth row voltage wave form in conjunction with a square wave column voltage wave form.

Referring now to the drawings, and more particularly to FIG. 1 there is shown, a schematic representation of a typical TFEL matrix display panel, of the prior art. The pixel, row and column labelling system is described as follows. Each row of electrodes is labelled with an upper case, or capital, letter starting with the letter A and increasing through the alphabet with descending rows of electrodes. Each column is labelled with lower case letters starting with the letter a and increasing through the alphabet for columns extending from left to right across the panel. Pixel $P_A{}^a$ represents the pixel which is the intersection between row A and column a. The intersection of row B and column c is at pixel $P_B{}^c$.

Now referring to FIG. 2 there is shown a voltage time plot for voltages applied to a panel with a labelling system similar to the panel of FIG. 1. A threshold voltage is shown as an intermittent line extending across FIG. 2. Generally, there is shown two separate and distinct time intervals where voltages are being supplied to pixels of the panel. In the first time interval a voltage $V^c$ is shown. A voltage $V_B$ is applied to row B. With the threshold voltage, as shown, neither $V_B$ on row B or $V^c$ on column c is by itself sufficient to exceed the threshold voltage. However, the combined voltage $V_B{}^c$ which represents the voltage across pixel $P_B{}^c$ is the combined voltage differences between column C and row b is at a level which exceeds the threshold. Several light rays are schematically shown as emanating from the pixel during this interval. The light ray Y $B^c$ is chosen to represent the light ray from pixel $P_B{}^c$. The second separate and distinct time interval which voltages are applied to the rows and columns of the matrix shows a column voltage $V^d$ applied to column d and a voltage $V_C$ applied to row C, with the combined voltage $V_C{}^d$ exceeding the threshold voltage for pixel $P_C{}^d$. Similarly, light rays are schematically shown a emanating from pixel $P_C{}^d$ during this time interval and are labelled as Y $C_d$.

With a drive technique similar to the prior art technique shown in FIG. 2 only one row is supplied with a voltage at any one given time.

Now referring to FIG. 3A there is shown a voltage time plot of the present invention. This plot shows three distinct time intervals during which luminescence will be initiated at a particular pixel. The first time interval 101 exists between time positions one and two along the time line. The second time interval 103 exists between the time positions three and four and similarly the third time interval 105 exists between the time positions five and six. Referring now to the first time interval 101 there is shown a voltage $V^c$ which represents approximately a square wave voltage which is applied to the column c. Also applied during the first time interval 101 is a voltage $V_B$ which is applied to row B. $V_B$ adds a rapid increase, to an initial peak region, and then a linear decrease. The individual voltage for $V^c$ and $V_B$ are each clearly below the threshold voltage at all times. However, the combined voltage at pixel $P_B{}^c$ refers to as $V_B$ c which does exceed the threshold voltage during the first time interval 101 for at least a portion of time interval 101. However, the combined voltage Of $V_B$ C does drop beneath the threshold voltage by the time point two. During this first time interval 101 a light ray 301 is schematically shown as emanating from pixel $P_B{}^c$. A first transitional time exists between the first time interval 101 and the second time interval 103 and is shown to be the time between time point two and time point three. It is understood that there is a need for some transitional time period for switching purposes, column however, the transitional time period would preferably be minimized and is chosen here as one time point only for convenience. It has been determined through experimentation that a light ray 303 will continue emanate from pixel $P_B{}^c$ during the time corresponding between time points two and three. This emanation of light occurs despite the fact that the voltage across pixel $P_B{}^c$ is clearly below the threshold voltage. During the second time interval 103 which exists between time points three and four, there is shown a voltage $V^d$ representing roughly a square wave which is applied to the column d. Also during the second time interval 103 there is shown a row voltage $V_C$ which is applied to row C. The combined voltages between $V^d$ and $V_C$ is represented by the voltage $V_C{}^d$ which corresponds to the voltage across pixel $P_C{}^d$. Similar to the combined voltage $V_B{}^c$ during the first time interval 101 the voltage $V_C{}^d$, during the second time interval 103, does extend above the threshold voltage and decreases to a point below the threshold voltage by the end of the second time A interval 103 at time point four. During this time, light ray 311 is emitted from pixel $P_C{}^d$. Also, the combined voltage $V_B{}^d$ is shown during the second time interval 103, this voltage is clearly beneath the threshold voltage and no unwanted luminescence is initiated from pixel $P_B^d$. During the time between the second time interval 103 and the third time interval 105 there exists second a transitional period similar to the first transitional period between points two and time point three. However, during this second transitional time period, there is shown schematically, to be the emission of a light ray 305 which emanates from pixel $P_B^c$ and also there is a light ray 313 emanating from pixel $P_C^d$. During the third time interval 105 there is shown a roughly square wave voltage $V^e$ which is applied to column e during the same time interval there is a voltage $V_D$ which is supplied to the row D. The combined voltage $V_D^e$ does extend above the threshold and decrease to a point below the threshold by time point six. A light ray 321 is schematically shown as emanating during the third time interval 105 and is emanating from pixel $P_D^e$. During the third time interval 105 there is also shown a voltage $V_C^e$ which is clearly below the threshold voltage, consequently there is no unwanted luminescence from pixel $P_C^e$. Similarly, there is shown a voltage $V_B^e$, also clearly below the threshold voltage which represents the fact that no new luminescence will initiate at pixel $P_B^e$. However, light ray 315 is schematically shown as being emitted during the third time interval 105. This emission is a manifestation of the sustaining voltage applied to pixel $P_C^d$. During the time between time point six and time point seven there is shown to be two light rays 323 and 325, schematically representing emissions from pixel $P_D^3$. This emission from pixel $P_D^e$ when the voltage $V_D^e$ across that pixel is significantly below the threshold voltage is also a manifestation of the light emissions caused by the sustaining voltage of this invention.

Figure 3B:
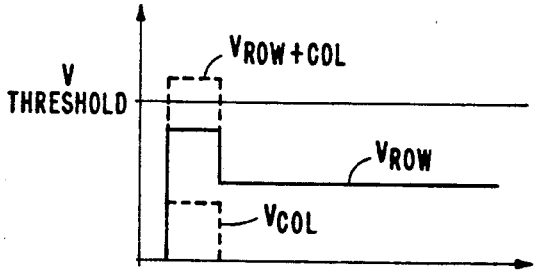
FIG. 3B is a representation of a voltage time plot of the present invention which demonstrates a square wave column voltage wave form in conjunction with a row voltage wave form having an initial peak and an extended plateau region.

Now referring to FIG. 3B there is shown a voltage time plot of the present invention which displays a variation in the wave form for the row voltages. In FIG. 3A the row voltages are essentially being driven as a saw tooth wave, while the row voltages are shown in FIG. 3B to include a first initial peak voltage, relatively short in duration, followed by a lower sustaining voltage for a relatively longer duration.

Figure 3C:
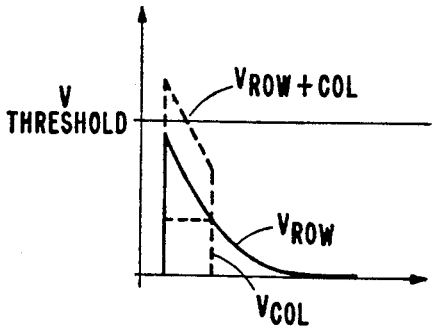
FIG. 3C is a representation of a voltage time plot of the present invention which shows a square wave column voltage wave form in conjunction with a row voltage wave form having an initial peak region which decays off exponentially to zero.

Now referring to FIG. 3C there is shown yet another voltage time plot, of the present invention which shows another possible variation of the wave form, for any given row. The row voltage V Row is shown as having an initial peak region relatively short in duration followed by a exponential decline in voltage.

Figure 4:
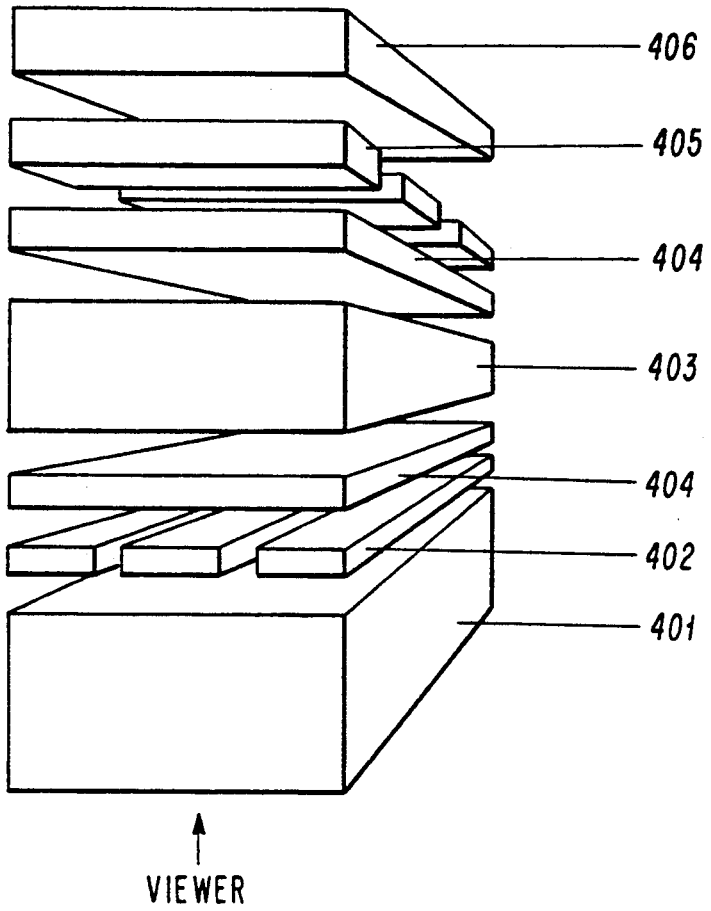
FIG. 4 PRIOR ART
FIG. 4 is a schematic perspective exploded representation of a typical TFEL matrix display panel, of the prior art, on which the present invention could be implemented.

Now referring to FIG. 4, there is shown a typical TFEL display panel which shows the direction from which a viewer observes the panel. FIG. 4 shows the sandwich of glass 401, transparent column electrodes 402, dielectric phosphor 403, dielectric 404, row electrodes 405 and glass 406 of a prior art TFEL display panel, upon which the present invention could be implemented.

It is thought that the display technique of the present invention and many of its attendant advantages will be understood from the foregoing description, and it will be apparent that various changes may be made in the form, construction, and arrangement of the parts thereof without department from the spirit and scope of the invention, or sacrificing all of their material advantages, the forms hereinbefore described being merely preferred or exemplary embodiments thereof. It is the intention of the appended claims to cover all such changes.

I claim:

1. A method for visually displaying information comprising the steps of:

a. providing a plurality of column electrodes, for receiving electrical signals;

b. providing a plurality of row electrodes, for receiving electrical signals, said row electrodes being arranged orthogonally with respect to said column electrodes;

c. providing a luminescent material for emitting light in response to electrical signals, said luminescent material being disposed between said column electrodes and said row electrodes;

d. providing a first column voltage signal to one of said plurality of column electrodes and said row electrodes;

d. providing a first column voltage signal to one of said plurality of column electrodes;

e. providing a first row voltage signal to a first of said plurality of row electrodes;

f. said first row voltage signal having a first initial peak region for providing sufficient voltage, in combination with said first column voltage signal, to exceed a predetermined threshold voltage level;

g. said first row voltage signal level having a first emission sustaining region which is longer in duration and lower in voltage with respect to said first initial peak region, said first emission sustaining region having a voltage level sufficiently low, so that, in combination with any voltage applied to any of said plurality of column electrodes, said emission sustaining region is below the predetermined threshold voltage level;

h. providing a second row voltage signal, to a second of said plurality of row electrodes, having a second initial peak region for providing sufficient voltage, in combination with any voltage signal that might be applied to any of said plurality of column electrodes, to exceed the predetermined threshold voltage level;

i. said second row voltage having a second emission sustaining region which is longer in duration and lower in voltage with respect to said second initial peak region, said second emission sustaining region having a voltage level sufficiently low, so that, in combination with any voltage applied to any of said plurality of column electrodes, said second emission sustaining region is below the predetermined threshold voltage level;

j. manipulating said first row voltage signal and said second row voltage signal, so that, said first initial peak region and said second initial peak region are not allowed to exist concurrently; and k. manipulating said first row voltage signal and said second row voltage signal, so that, said second initial peak region is made to exist concurrently with said first emission sustaining region;

l. manipulating said first row voltage signal so that said first emission sustaining region is eliminated prior to any further manipulation of said first row voltage signal to include a first subsequent peak region;

light emission is initiated when said first column voltage signal and said first initial peak region of said first row voltage signal are provided and light emission is sustained during the providing of the first emission sustaining region while concomitantly providing for new emission initiation during the providing of the second initial peak region of said second row voltage signal and light emission is terminated when said first emission sustaining region is eliminated.

2. A method of claim 1 wherein the first initial peak region is a signal region having a rapid rise to a voltage peak above a predetermined row peak voltage threshold level followed by a period where the signal remains above the predetermined row peak threshold level which then ultimately terminates at a voltage level below the predetermined row peak voltage threshold level.

3. A method of claim 2 wherein the initial peak region is a square pulse voltage signal above the predetermined row peak voltage threshold level.

4. A method of claim 3 wherein the first emission sustaining region comprises a rectangular pulse voltage signal at a level below the predetermined row peak voltage threshold level.

5. A method of claim 1 wherein the first initial peak region and the first emission sustaining region, when combined, create a single tooth of a saw tooth voltage signal.

6. A method of claim 1 wherein the first initial peak region and the first emission sustaining region, when combined, create a voltage signal having an exponential decay in voltage over time.

7. A technique for driving the voltage levels on row electrodes for electroluminescent matrix displays of the type having a plurality of parallel row electrodes and a plurality of parallel column electrodes which are orthogonal to the plurality of row electrodes and the column electrodes being driven by the application of a voltage signal during a time interval when luminescence is desired at a point along the column electrode, wherein the technique comprises: providing a row voltage signal to a predetermined row electrode having an initial peak region and a sustaining region, with the initial peak region being higher in voltage and shorter in duration with respect to the sustaining region, so that when the row voltage signal is in its initial peak region it is sufficiently high, in combination with a column voltage signal, to exceed a predetermined threshold level, and it is sufficiently low not to exceed the predetermined threshold level when no column voltage is applied, and the sustaining region being sufficiently low in level that it will not exceed the predetermined threshold level regardless of whether any column voltage are applied, but be sufficiently high to provide for sustaining light emissions after the predetermined threshold voltage has been earlier exceeded said sustaining region terminating prior to any re-application of any initial peak region to said predetermined row electrode.

8. A method of claim 7 wherein the initial peak region is a signal region having a rapid rise to a voltge peak above a predetermined row peak votlage threshold level followed by a period wherein the signal remains above the predetermined row peak voltage level which ultimately terminates at a voltage below the predetermined row peak voltage threshold level.

9. A method of claim 8 wherein the initial peak region is a square pulse voltage signal above the predetermined row peak voltage threshold level.

10. A method of claim 9 wherein the sustaining region comprises a rectangular pulse voltage signal at a level below the predetermine row peak voltage threshold level.

11. A method of claim 7 wherein the initial peak region and the sustaining region, when combined, create a single tooth of a saw tooth voltage signal.

12. A method of claim 7 wherein the initial peak region and the sustaining region, when combined, create a voltage signal having an exponential decay in voltage over time.

* * * * *